United States Patent [19]

Moomaw

[11] 4,079,542

[45] Mar. 21, 1978

[54] PARACHUTE TOY

[75] Inventor: David E. Moomaw, Blasdell, N.Y.

[73] Assignee: The Quaker Oats Company, Chicago, Ill.

[21] Appl. No.: 737,610

[22] Filed: Nov. 1, 1976

[51] Int. Cl.[2] ..... A63H 33/20

[52] U.S. Cl. ..... 46/86 R

[58] Field of Search ..... 46/86 R, 86 A, 86 B, 46/86 C

[56] References Cited

U.S. PATENT DOCUMENTS

| | | | |
|---|---|---|---|
| 3,432,962 | 3/1969 | Boese | 46/86 R |
| 3,553,885 | 1/1971 | Tazaki | 46/116 |

*Primary Examiner*—Louis G. Mancene
*Assistant Examiner*—Mickey Yu
*Attorney, Agent, or Firm*—Cumpston & Shaw

[57] ABSTRACT

A parachute toy has flexible shrouds molded of a single piece of resin material connecting the shrouds together at their lower ends where they are attached to a body. The upper ends of the shrouds are freely separable and are formed with headed snap fasteners for quick manual connection or disconnection with grommets in the canopy. A simulated harness is preferably molded integrally with the shrouds for releasable attachment to a body.

10 Claims, 4 Drawing Figures

PARACHUTE TOY

BACKGROUND OF THE INVENTION

Parachute toys have been popular as long as parachutes have been used, and they have simulated parachutes in various ways. Their shrouds have usually been formed of strings tied to the canopy, and these are easily tangled and difficult to assemble or disassemble.

The invention involves recognition of a simpler and more convenient way of forming toy parachute shrouds of a molded resin material so that the shrouds are less susceptible to tangling, are easily and conveniently connected to or disconnected from the canopy, and readily integrated with a simple and effective harness. The invention aims at economy, convenience, effectiveness, and durability in a parachute toy that makes play possibilities more attractive.

SUMMARY OF THE INVENTION

The inventive parachute toy has a body, a canopy, and several shrouds for connecting the canopy to the body. The shrouds are formed as portions of a single molded piece of flexible resin material joining the lower ends of the shrouds near the body and leaving the upper ends of the shrouds freely separable. The upper end of each of the shrouds is formed with one part of a two-part fastener for quick manual connection and disconnection, and the canopy is formed with the other parts of the two-part fasteners positioned for receiving the shrouds. The body is attachable to the connected lower ends of the shrouds, and a harness for attachment to the body is preferably molded of the same piece of resin material to be integral with the lower ends of the shrouds.

DRAWINGS

DETAILED DESCRIPTION

Figure 1:
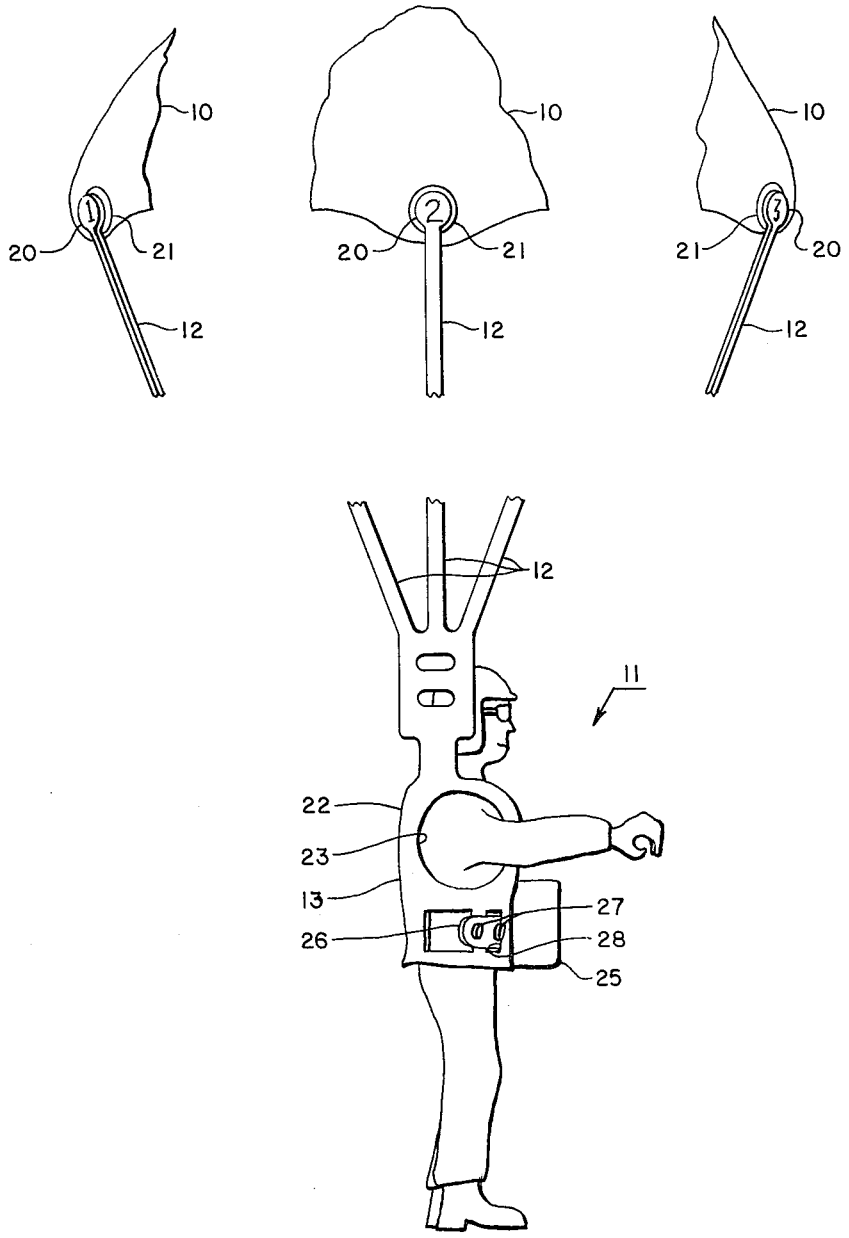
FIG. 1 is a partially cut-away, side elevational view of one preferred embodiment of the inventive parachute toy.

The parachute toy of FIG. 1 includes a canopy 10, preferably formed of fabric or resin material for dropping body 11 slowly downward through the air. Body 11 is a simulated human figure preferably molded of resin material, but can have many other forms, including other figures, objects, or cargo. Body 11 is connected to canopy 10 by several shrouds 12 that are preferably formed of a flexible molded resin material as described more fully below, and shrouds 12 are preferably joined to a simulated harness 13 that is releasably attachable to body 11.

Figure 2:
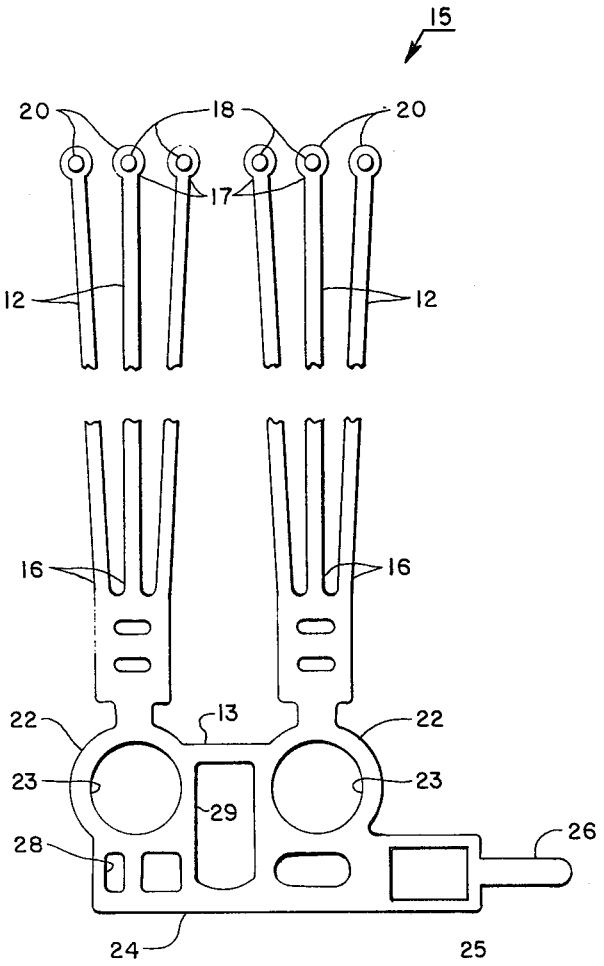
FIG. 2 is a partially cut-away, front elevational view of a preferred embodiment of the inventive shrouds and harness.
Figure 3:
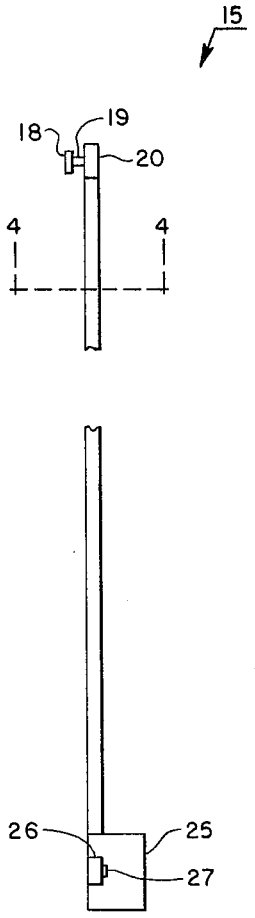
FIG. 3 is a partially cut-away, side elevational view of the shrouds and harness of FIG. 2.
Figure 4:
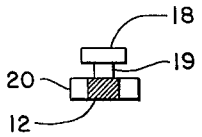
FIG. 4 is a cross sectional view of one of the shrouds of FIG. 3, taken along the line 4—4 thereof.

FIGS. 2–4 show a preferred form for shrouds 12 and harness 13. A single piece of tough and easily flexed resin material 15 is preferably injection molded in a configuration such as shown in the drawings to form shrouds 12, which are connected together by the resin material at their lower ends 16. Shrouds 12 are preferably molded in generally parallel relation in a plane and preferably extend for a substantial length from their lower ends 16 to their freely separable upper ends 17. The upper ends 17 of shrouds 12 are connected to canopy 10 with a fastener that allows quick manual connection and disconnection. The preferred fastener is a snap fastener formed by a snap head 18, a neck 19, and a flange 20, all molded of the resin material at each of the upper ends 17 of shrouds 12. The other parts of the fasteners are grommets 21 located appropriately around the perimeter of canopy 10 so that heads 18 can be releasably and quickly snapped into place in grommets 21. Flanges 20 preferably have successive molded numbers as shown in FIG. 1 to aid in fastening shrouds 12 to canopy 10 in the proper order around the perimeter of canopy 10. Fasteners other than snap fasteners can also be used, providing the connection between the canopy 10 and shrouds 12 is manually fast and convenient.

Shrouds 12, with their parallel spacing and original molding in a plane as preferred, tend to relax or return to their original position under the influence of the "memory" of the flexible resin material of which they are formed. This tends to keep shrouds 12 from tangling and makes any tangles easier to unravel. The easily operated fasteners at the upper ends of shrouds 12 also facilitate unravelling any tangles that may occur. Shrouds 12 are preferably flexible enough and light enough in weight to function very well in a parachute toy and improve substantially in convenience and appearance over strings. Shrouds 12 are also preferably approximately rectangular in cross section as best shown in FIG. 4 for convenience of molding, attractive appearance, and to help prevent shroud tangling or twisting. The shrouds are then easily connected to canopy 10 in a consistent and untwisted orientation that allows the shrouds to spread open and cooperate with the canopy to operate successfully as a parachute.

The connected lower ends 16 of shrouds 12 can be attached to a body in various ways to complete a parachute toy, but harness 13 is preferably molded integrally with shrouds 12 and made releasably attachable to body 11 to form an attractive parachute simulation. Harness 13 is preferably molded in a generally flat orientation in the plane of shrouds 12 as best shown in FIGS. 2 and 3 and preferably includes shoulder pieces 22 having arm openings 23 and a waistband 24 for encircling the waist of body 11. Waistband 24 preferably includes a simulated parachute pack 25, a fastener tab 26 having a detent 27, and an opening 28 for receiving tab 26 and releasably connecting waistband 24 to body 11 by an interlock occurring between detent 27 and the edge of opening 28. Various openings 29 are also preferably molded in harness 13 to improve its simulation. Harness 13 is attached to body 11 by inserting the arms of body 11 through arm openings 23 to position shoulder straps 22 over the shoulders of body 11 and then wrapping waistband 24 around the waist of body 11 and securing harness 13 in place by inserting fastener tab 26 through opening 28 so that detent 27 interlocks with an edge of opening 28. There are many other ways that harness 13 can be formed and other convenient ways of attaching it to a body to be dropped. Also, instead of harness 13 simulating a harness for a human figure, different harnesses can be made for dropping objects and cargo.

Play possibilities with the inventive toy include rigging and unrigging the harness and shroud relative to body 11 and canopy 10 and shooting the toy into the air or dropping it in various ways. The tangles that inevitably occur are easily undone by disconnecting and reconnecting the shrouds, and molded resin shrouds according to the invention are far less likely to tangle, anyway. The preferred numbers on flanges 20 facilitate both play and manufacturing assembly, and the toy is more readily dislodged from any entanglement with a tree or other obstacle.

Those skilled in the art will appreciate the many forms possible for the inventive toy and the different materials suitable for its manufacture, once they have understood the basic concepts of the invention. Many different fasteners and shroud and harness configurations are possible, and the preferred embodiment shown in the drawings merely illustrates one of many possibilities.

What is claimed is:

1. A parachute toy having a body, a canopy, and a plurality of shrouds formed as portions of a single molded piece of flexible resin material with lower ends of said shrouds connected by said resin material in the region of said body, said parachute toy comprising:

a. said shrouds having upper ends that are freely separable, and said shrouds being flexible enough so said upper ends are freely movable relative to each other;

b. said upper ends of each of said shrouds being formed with one part of a two-part, resilient fastener;

c. said canopy being formed with the other parts of said two-part, resilient fasteners positioned in spaced relation around the perimeter of said canopy for fastening to said shrouds;

d. said two-part, resilient fasteners being formed for quick manual connection and disconnection of said shrouds and said canopy; and e. means for attaching said body to said connected lower ends of said shrouds.

2. The parachute toy of claim 1 wherein said one part of each of said fasteners is a headed snap fastener and said other part of each of said fasteners is a grommet.

3. The parachute toy of claim 1 wherein said shrouds are formed with a generally rectangular cross section.

4. The parachute toy of claim 1 wherein said shrouds are molded in generally parallel relation in a plane.

5. The parachute toy of claim 4 wherein said shrouds are formed with a generally rectangular cross section.

6. The parachute toy of claim 1 including a harness releasably attachable to said body and molded of said piece of resin material to be integral with said connected lower ends of said shrouds.

7. The parachute toy of claim 6 wherein said shrouds are molded in generally parallel relation in a plane.

8. The parachute toy of claim 7 wherein said shrouds are formed with a generally rectangular cross section.

9. The parachute toy of claim 6 wherein said one part of each of said fasteners is a headed snap fastener and said other part of each of said fasteners is a grommet.

10. The parachute toy of claim 9 wherein said shrouds are molded in generally parallel relation in a plane and formed with a generally rectangular cross section.

* * * * *